US009332609B1

(12) United States Patent
Rhodes et al.

(10) Patent No.: US 9,332,609 B1
(45) Date of Patent: May 3, 2016

(54) PHASE CUT DIMMING LED DRIVER

(71) Applicant: Illum Technology LLC, Tempe, AZ (US)

(72) Inventors: James Rhodes, Tempe, AZ (US); Arthur Wilkes, Tempe, AZ (US); Mark Busier, Tempe, AZ (US)

(73) Assignee: ILLUM TECHNOLOGY, LLC, Tempe, AZ (US)

( * ) Notice: Subject to any disclaimer, the term of this patent is extended or adjusted under 35 U.S.C. 154(b) by 0 days.

(21) Appl. No.: 14/592,560

(22) Filed: Jan. 8, 2015

(51) Int. Cl.
*H05B 37/02* (2006.01)
*H05B 33/08* (2006.01)

(52) U.S. Cl.
CPC ..... *H05B 33/0851* (2013.01); *H05B 33/0815* (2013.01)

(58) Field of Classification Search
CPC . H05B 33/0815; H05B 33/0887; H05B 37/02
USPC ..... 315/206, 297
See application file for complete search history.

(56) References Cited

U.S. PATENT DOCUMENTS

2011/0285301 A1* 11/2011 Kuang ..... H05B 33/0845 315/200 R
2012/0056551 A1* 3/2012 Zhu ..... H02M 1/4258 315/232
2012/0098463 A1* 4/2012 Stamm ..... H05B 33/0848 315/307
2013/0049589 A1* 2/2013 Simi ..... H05B 33/0815 315/85
2013/0113375 A1* 5/2013 Leung ..... H05B 33/0815 315/85
2013/0175940 A1* 7/2013 O'Neil ..... H05B 33/0845 315/224
2013/0214697 A1* 8/2013 Archenhold ..... H05B 33/0845 315/291
2013/0241440 A1* 9/2013 Gaknoki ..... H02M 7/217 315/297
2013/0258280 A1* 10/2013 Goto ..... A61B 3/14 351/206
2014/0159608 A1* 6/2014 Simi ..... H05B 33/0815 315/205
2015/0173145 A1* 6/2015 Lee ..... H05B 33/0815 315/200 R
2015/0264769 A1* 9/2015 Jelaca ..... H05B 33/0845 315/206

* cited by examiner

*Primary Examiner* — Don Le
(74) *Attorney, Agent, or Firm* — Foster Pepper PLLC; Richard A. Koske; P. G. Scott Born

(57) ABSTRACT

A phase cut dimming LED driver includes a rectifier, a phase cut hold, a local regulator, controller, a power switch, a transformer, and a load detector. The phase cut hold is connected to the rectifier, one terminal of the primary winding of the transformer, and the local regulator. The controller includes pins connected to the local regulator, the power switch, and the aux winding of the transformer. The power switch is connected to the other terminal of the primary winding. The load detector is connected between the secondary winding of the transformer and a LED. The load detector sends the voltage or current signal of the LED to the controller, and the controller controls the power switch in an uninterrupted mode to keep the current or voltage in a condition to obtain higher PF and lower THD.

8 Claims, 2 Drawing Sheets

PHASE CUT DIMMING LED DRIVER

FIELD OF THE INVENTION

This invention relates to an AC phase cut dimming (phase cut dimmers can be triac leading edge, triac trailing edge, or IGBT types) dimming LED driver, and more particularly, to a phase cut dimming LED driver with high power factor (PF) and low total harmonic distortion (THD).

BACKGROUND

The illumination device is used at night or in situations where raising the level of illumination is desired. It consumes electrical power, and can be switched off in situations where enough illumination is present to save power. In some cases, such as at nightfall or a misty day, illumination is needed but the light from the illuminating device may be stronger than what is needed. In some cases the illumination device could be turned off to save power, however, in other cases the illumination device must be kept on, hence wasting power since the full intensity is generated. If the illumination of the light emitted by the illumination device is adjustable, it could be regulated to the level just required and power could be effectively saved.

For the solid state illumination device, such as light emitting device (LED), the light could be dimmed by several dimming technologies, including phase cut dimming. Compared to other dimming technologies, the phase cut dimming has advantages such as low cost and an agreed standard. Because of the low cost, it is the most popular dimming technology used in the general lighting dimming field. However, with LED lighting, there are problems with the conventional phase cut dimming that needs to be solved.

A conventional phase cut dimming device includes a phase cut for chopping a portion of each waveform of the input voltage signal to change the input power of LEDs, a RC timer for changing the conduction angle of the phase cut, and a trigger for triggering the phase cut. The power factor of the conventional phase cut dimming device decreases rapidly when the conduction angle decreases. For example, the power factor (PF) is lower than 0.25 when the illumination of the LED is adjusted to 25% of the original illumination. On the other hand, while the total harmonic distortion (THD) of the conventional phase cut dimming can be lower than 30%, it is still too large for effective LED dimming.

Low PF and high THD are negatives to the overall performance of LED dimming. Therefore, the PF and THD problems of the conventional phase cut dimming should be solved to raise the effective dimming capability of a phase cut dimming LED driver.

SUMMARY OF THE INVENTION

One object of the present invention is to provide a novel phase cut dimming LED driver. The phase cut dimming LED driver in the present invention has better PF and THD than those of a conventional phase cut dimming LED driver so as to increase the dimming and control performance by operating in an "uninterrupted control mode" which allows for increased PF and lower THD.

According to an embodiment of the invention, a phase cut dimming LED driver used for receiving an AC power source and dimming the illumination of a LED supplied by the AC power source. The phase cut dimming LED driver comprises a rectifier, a phase cut hold, a local regulator, a controller, a power switch, a transformer, and a load detector. The rectifier comprises a rectifier input and a rectifier output, and the rectifier input is used for being connected to a power source. The phase cut hold is connected to the rectifier output. The local regulator comprises a regulator input and a regulator output, wherein the regulator is connected to the rectifier output. The controller comprises a Vcc pin, a phase pin, an aux pin, an output pin, a CS pin, a FB pin and a ground pin, wherein the Vcc pin is connected to the regulator output, the phase pin is connected to the regulator input, and the ground pin is connected to ground. The power switch is connected to the output pin and the CS pin. The transformer comprises a primary winding, a secondary winding, and an aux winding. The primary winding is connected between the rectifier output and the power switch, and the aux winding is connected between the aux pin and ground. The load detector is connected between the secondary winding and a LED, and it is connected to the FB pin too.

In this embodiment, the controller chases the voltage or the current from the load detector to keep the voltage or the current constant, so as to raise PF and lower THD of the phase cut dimming LED driver.

On the other hand, the controller is always on and scales the input power to follow the AC power waveform in the uninterrupted control mode, so as to control the phase cut hold to be certain that the phase cut dimmer is always in conduction.

On the advantages and the spirit of the invention, it can be understood further by the following invention descriptions and attached drawings.

DETAILED DESCRIPTION

Figure 1:
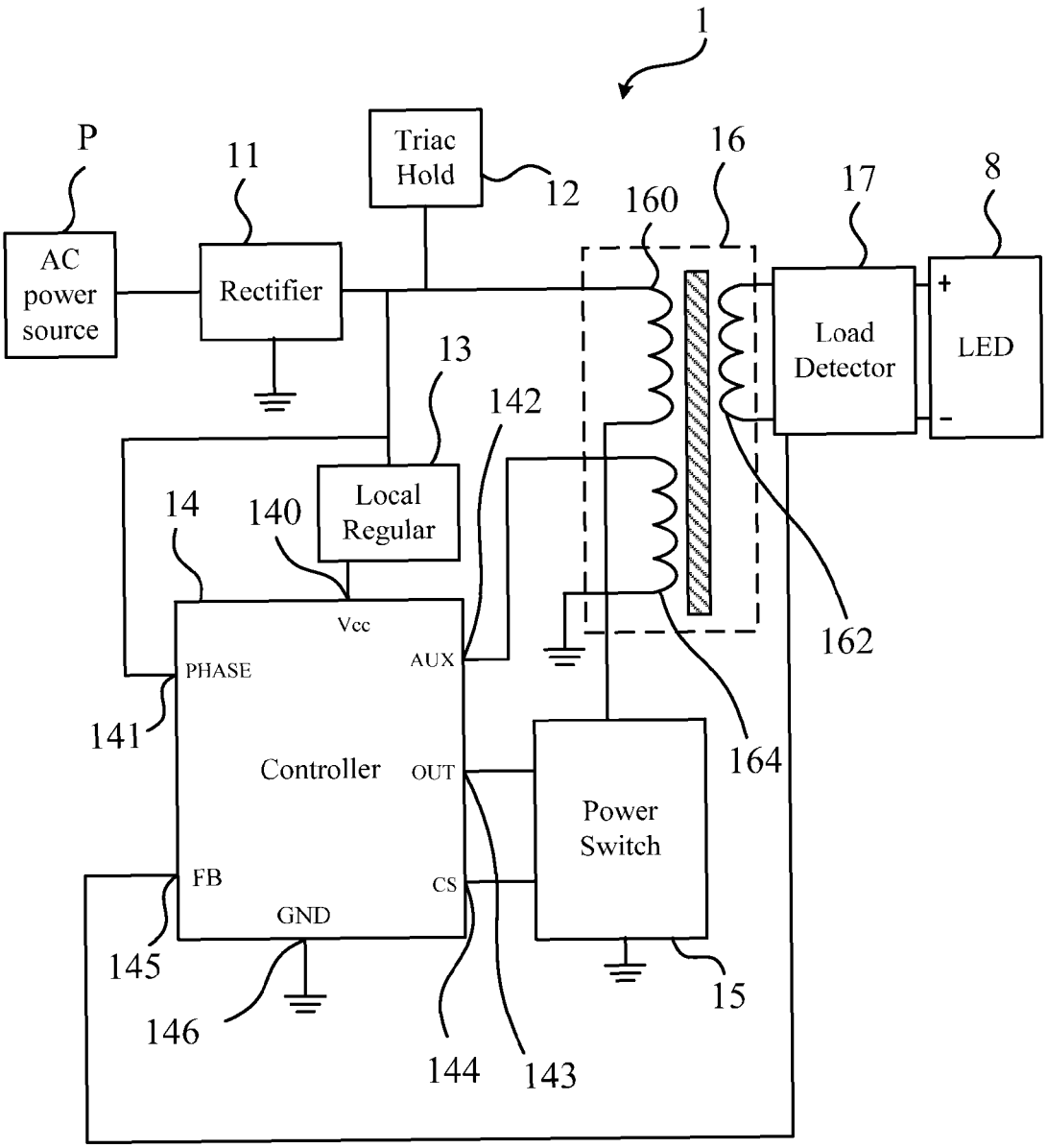
FIG. 1 is a schematic diagram illustrating a phase cut dimming LED driver according to an embodiment of the invention.

Please refer to FIG. 1. FIG. 1 is a schematic diagram illustrating a phase cut dimming LED driver 1 according to an embodiment of the invention. As shown in FIG. 1, the phase cut dimming LED driver 1 includes a rectifier 11, a phase cut hold 12, a local regulator 13, a controller 14, a power switch 15, a transformer 16, and a load detector 17.

In this embodiment, the rectifier 11 has rectifier inputs (terminal at left side of the rectifier 11) and a rectifier output (right side of the rectifier 11). The rectifier inputs are capable of being connected to an AC power source P to receive the power. The phase cut hold 12 is connected to the rectifier output of the rectifier 11, for processing the dimming functions. The local regulator 13 has a regulator input (up side of the local regulator 13) and a regulator output (down side of the local regulator 13). The regulator input is connected to the rectifier output of the rectifier 11, and also connected to the phase cut hold 12.

The controller 14 includes many pins, such as a Vcc pin 140, a phase pin 141, an aux pin 142, an output pin 143, a CS pin 144, a FB pin 145, and a ground pin 146. The Vcc pin 140 is connected to the regulator output of the local regulator 13. The phase pin 141 is connected to the regulator input of the local regulator 13. The ground pin 146 is used for being connected to ground. The power switch 15 is connected to the output pin 143 and the CS pin 144. The transformer 16 comprises a primary winding 160, a secondary winding 162, an aux winding 164. The primary winding 160 is connected between the rectifier output of the rectifier 11 and the power switch 15. The aux winding 164 is connected between the aux pin 142 of the controller 14 and ground. The load detector 17 is connected between the secondary winding 162 and a LED 8, and it is also connected to the FB pin 145 of the controller 14.

In this embodiment, the controller 14 receives the voltage or current signal from the load detector 17, and then according to the received signal to feedback control to keep the voltage or the current constant. In practice, there could be a constant voltage mode and a constant current mode establish in the controller 14, and one of them can be selected when the phase cut dimming LED driver 1 is in motion. The controller 14 monitors the voltage or current signal of LED load directly and regulates at the power switch 15 accordingly, and it is an uninterrupted control at the primary side. The uninterrupted control allows the phase cut hold 12 to always remain in conduction, hence, there would be no flicker generated by the phase cut dimming LED driver 1.

In this embodiment, the controller 14 controls the power switch 15 to generate an adjustable load, and the controller 14 continuously adjusts the adjustable load in an uninterrupted control mode according to the AC waveform provided by the AC power source P. The AC waveform provided by the AC power source is a sine wave, and the voltage of the sine wave varies periodically. In the uninterrupted control mode, the controller 14 increases the adjustable load with the increase of the voltage of the sine wave, and the controller 14 decreases the adjustable load with the decrease of the voltage of the sine wave. The controller 14 decreases adjustable load to near zero but stay on at the AC zero crossing. The uninterrupted control mode keeps the PF high, and the THD low by allowing even at zero cross, or near zero cross, which in turn allows for smooth operation at any phase cut dimming angle. The LED does not flicker as well since the LED never sees an interruption in either voltage or current.

During the phase cut dimming LED driver 1 running, the power factor (PF) is greater than 0.99 and the total harmonic distortion (THD) is below 20% and normally in low teens The higher the power factor is, the more effective the phase cut dimming LED driver will be. THD is low enough in the phase cut dimming LED driver 1 so that the power switch node is never on when it is at the zero crossing. Compared to the conventional phase cut dimming LED driver in the prior art, whose PF is larger than 0.9 and THD is about 30%, the phase cut dimming LED driver 1 in the present invention is more effective and precise.

Figure 2:
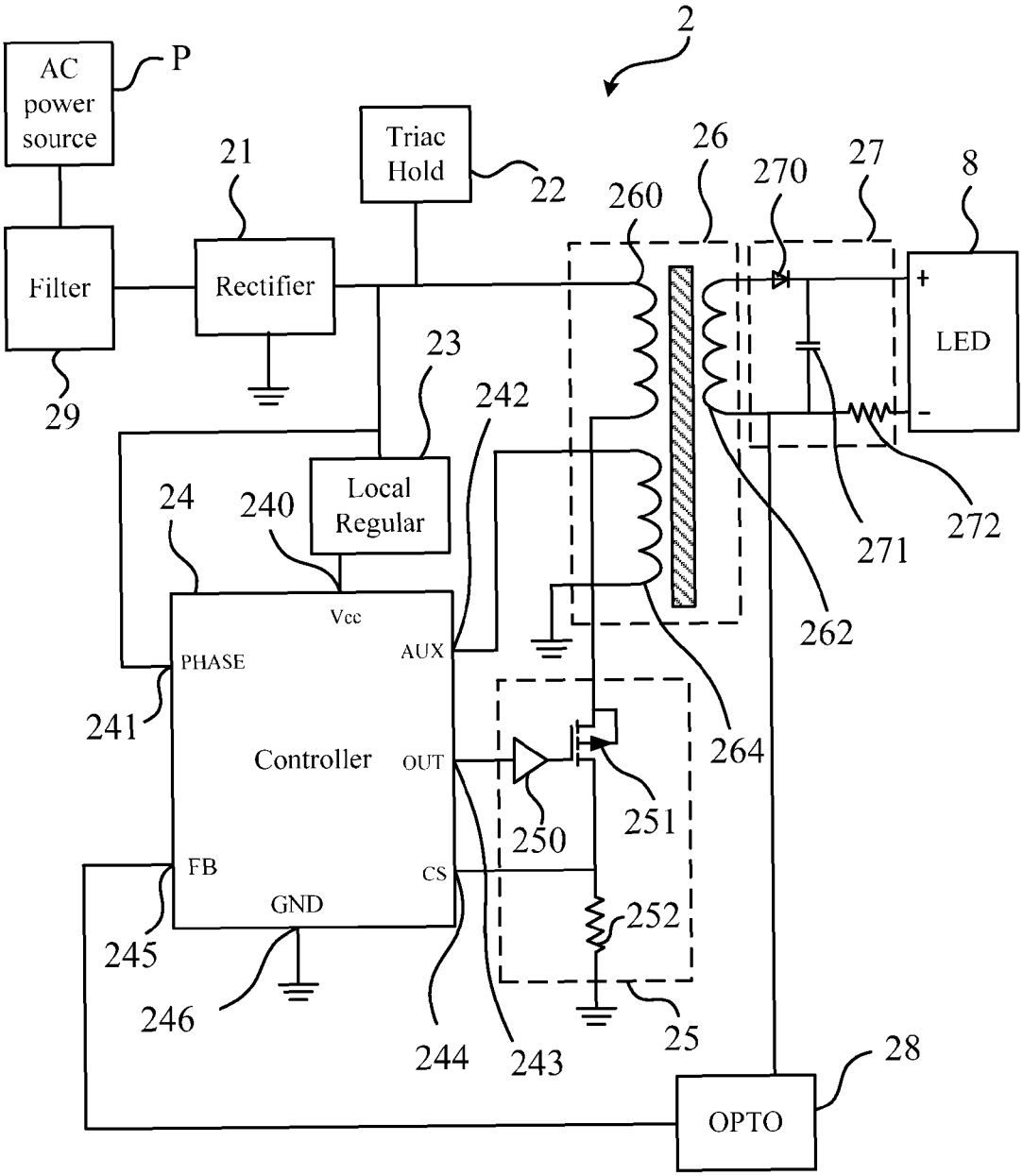
FIG. 2 is a schematic diagram illustrating a phase cut dimming LED driver according to another embodiment of the invention.

Please refer to FIG. 2. FIG. 2 is a schematic diagram illustrating a phase cut dimming LED driver 2 according to another embodiment of the invention. As shown in FIG. 2, the power switch 25 in this embodiment further includes an operational amplifier (OPAMP) 250, a MOSFET 251, and a first resistance 252. The input of the OPAMP 250 is connected to the output pin 243, and the output of the OPAMP 250 is connected to the gate of the MOSFET 251. The source of the MOSFET 251 is connected to the primary winding 260, and the drain of the MOSFET 251 is connected to the CS pin 244 of the controller 24. The first resistance 252 is connected between the CS pin 244 and ground. The power switch 25 is controlled by the controller 24 to adjust the input signal to the primary winding 260.

In addition, the load detector 27 of the phase cut dimming LED driver 2 in this embodiment as shown in FIG. 2 further includes a diode 270, a capacitance 271, and a second resistance 272. The anode of the diode 270 is connected to the anode of the LED 8, and the cathode of the diode 270 is connected to a first terminal of the secondary winding 262. The second resistance 272 is connected between a second terminal of the secondary winding 262 and the cathode of the LED 8. The anode of the diode 270 and the anode of the LED 8 form a first junction and the second resistance 272 and the second terminal of the secondary winding 261 form a second junction. The capacitance 271 is connected between the first junction and the second junction. The circuit of the load detector 27 provides not only signal detection function but also rectifier and filter functions.

In this embodiment, the phase cut dimming LED driver 2 further includes optical-coupler (OPTO) 28 connected to the second junction and the FB pin 245 of the controller 24. The controller 24 is capable of receiving the voltage signal or the current signal from the load detector 27 through the optical-coupler 28.

In this embodiment, the phase cut dimming LED driver 2 further includes a filter 29 connected between the AC power source P and the rectifier 21. The filter 29 can protect the driver from electromagnetic interference (EMI). The other elements of this embodiment have the same functions as the corresponding elements do in the last embodiment, and are not described in detail again here.

The phase cut dimming LED drivers in the above embodiments monitor the RMS voltage but not the phase cut phase cut conditions to keep the true constant current or the true constant voltage, so that the PF and the THD of the phase cut dimming LED drivers in this invention are better than those of the conventional phase cut dimming LED drivers. The response loop of the phase cut dimming LED drivers in this invention is slower than that of the conventional phase cut dimming LED drivers, acting like a purely resistive load so as to allow us to ride through the transients.

In practice, the phase cut dimming LED driver in this invention is capable of performing dimming by maximizing the circuit current delivery, but it is allowed to be scaled down when the phase cut dimmer is lowered by reducing the available power at AC power source. In this embodiment, the controller 24 controls the MOSFET 251 to generate an adjustable load. The controller 24 keeps sending control logic to the MOSFET 251 to adjust the adjustable load in an uninterrupted control mode according to the AC waveform provided by the AC power source P. In the uninterrupted control mode, the controller 24 increases the adjustable load with the increase of the voltage of the sine wave, and the controller 24 decreases the adjustable load with the decrease of the voltage of the sine wave. The controller 24 decreases the adjustable load to near zero but stay on at the AC zero crossing, so as to keep the phase cut hold 22 in condition even at the AC zero crossing. During the phase cut dimming LED driver performing dimming, PF is maintained high and THD is maintained low, and the phase cut hold will always remain in conduction.

According to another embodiment, two or more of the phase cut dimming LED drivers can be easily parallel connected together to provide a higher power delivery to the LED load. In another embodiment, the phase cut dimming LED drivers compensate at the first boot-up for all parasitics in the load condition, so as to have the ability to connect a long string LEDs or a long distance remotely located LED. By monitoring the output voltage or current signal and regulating the input conditions accordingly but not monitoring the phase cut angle, the phase cut dimming LED drivers in this invention is able to handle line surges by simply reducing the output current to the load.

As described above, the major difference between the present invention and the prior art is that the phase cut dimming LED driver monitors the output voltage or current signal but not the phase cut angle, and then PF and THD of the phase cut dimming LED driver in this invention are better than those of the conventional phase cut dimming LED driver in the prior art due to the fact that the present invention operates in an uninterrupted control mode, allowing the LED driver to always be in control of the electrical environment. This also allows the phase cut dimming LED driver disclosed in this invention to have other advantages such as no flicker, ability to handle line surges, ability to connect to a long string of LEDs, and ability to easily parallel several phase cut dimming LED drivers to provide high power delivery.

Although the present invention has been illustrated and described with reference to the preferred embodiment thereof, it should be understood that it is in no way limited to the details of such embodiment but is capable of numerous modifications within the scope of the appended claims.

The invention claimed is:

1. A phase cut dimming LED driver, comprising:

a rectifier, comprising a rectifier input for being connected to an AC power source and a rectifier output;

a phase cut hold, connected to the rectifier output;

a local regulator, comprising a regulator input connected to the rectifier output and a regulator output;

a controller, comprising a Vcc pin connected to the regulator output, a phase pin connected to the regulator input, an aux pin, an output pin, a CS pin, a FB pin and a ground pin connected to ground;

a power switch, connected to the output pin and CS pin of the controller;

a transformer, comprising a primary winding connected between the rectifier output and the power switch, a secondary winding, and an aux winding connected between the aux pin and ground; and a load detector, connected between the secondary winding and a LED, the load detector being connected to the FB pin;

wherein the controller monitors a voltage or a current of the LED from the load detector.

2. The phase cut dimming LED driver of claim 1, wherein the power switch further comprises:

an OP amplifier, comprising an amplifier input connected to the output pin of the controller and an amplifier output;

a MOSFET, comprising a gate connected to the amplifier output, a source connected to the primary winding, and a drain connected to the CS pin; and a first resistance connected between the CS pin and ground.

3. The phase cut dimming LED driver of claim 1, wherein the load detector comprises a diode having an anode connected to the LED anode and a cathode connected to a first terminal of the secondary winding, a second resistance connected between a second terminal of the secondary winding and the LED cathode, and a capacitance connected between the junction of the anode of the diode and the LED anode and the junction of the second terminal of the secondary winding and the second resistance.

4. The phase cut dimming LED driver of claim 3, further comprising an optical-coupler connected between the load detector and the FB pin.

5. The phase cut dimming LED driver of claim 4, wherein the optical-coupler is connected between the second terminal of the secondary winding and the FB pin of the controller.

6. The phase cut dimming LED driver of claim 1, further comprising a filter connected between the AC power source and the rectifier.

7. The phase cut dimming LED driver of claim 1, wherein the controller monitors the voltage or current to keep the voltage or current constant.

8. The phase cut dimming LED driver of claim 1, wherein the controller operates in an uninterrupted control mode to control the MOSFET to generate an adjustable load according to the AC waveform provided by the AC power source.

* * * * *